US005186341A

United States Patent [19]

Zeid

[11] Patent Number: 5,186,341

[45] Date of Patent: Feb. 16, 1993

[54] SUPPORT SYSTEM FOR HANGING ITEMS

[76] Inventor: Michael R. Zeid, 4640 Ravine Dr., Bloomfield Township, Oakland County, Mich. 48301

[21] Appl. No.: 818,390

[22] Filed: Jan. 9, 1992

[51] Int. Cl.[5] ..... A47B 47/00

[52] U.S. Cl. ..... 211/204; 211/123; 248/121

[58] Field of Search ..... 248/121, 231.9, 251; 211/204, 193, 123, 105.1

[56] References Cited

U.S. PATENT DOCUMENTS

| | | | |
|---|---|---|---|
| 2,516,907 | 7/1945 | Penfold | 285/174 |
| 2,660,457 | 11/1953 | Mallon | 285/175 |
| 3,043,438 | 7/1962 | Chmielewski | 211/123 |
| 3,121,497 | 2/1964 | Brochstein | 211/178 |
| 3,164,255 | 1/1965 | Jay | 211/193 X |
| 3,246,768 | 4/1966 | Carlos | 211/178 |
| 3,395,811 | 8/1968 | Bellock | 211/178 |
| 4,316,547 | 2/1982 | Varon | 248/251 X |
| 4,494,896 | 1/1985 | DiFranco | 410/148 |
| 4,700,918 | 10/1987 | Andrasko, Jr. | 211/123 X |
| 4,747,621 | 5/1988 | Gans et al. | 285/7 |
| 4,762,238 | 8/1988 | Blanchard | 211/123 |
| 4,819,812 | 4/1989 | Demarest, Jr. | 211/123 X |
| 4,932,540 | 6/1990 | Pfeifer | 211/204 |
| 4,981,227 | 1/1991 | Ingram | 211/204 |

*Primary Examiner*—Ramon O. Ramirez
*Attorney, Agent, or Firm*—Krass & Young

[57] ABSTRACT

A device for supporting hangable items thereupon and a modular system incorporating such devices. A support surface having a socket formed therein and an elongated substantially horizonatally oriented rod having a detent mechanism disposed thereon are engaged such that the detent mechanism is secured within the socket and the rod extends away from the support surface in a cantilever fashion.

7 Claims, 1 Drawing Sheet

SUPPORT SYSTEM FOR HANGING ITEMS

BACKGROUND OF THE INVENTION

1. Field of the Invention

This invention relates generally to the field of support systems and racks for hanging items thereupon and more particularly concerns an easily assembled collapsible device having a support surface with a rod extending substantially horizontally therefrom in a cantilever fashion and a modular support system incorporating a plurality of such devices.

2. Description of the Relevant Prior Art

A wide variety of support systems and racks for hanging items are known. For example, U.S. Pat. No. 4,981,227 teaches a free standing garment display rack; U.S. Pat. No. 4,762,238 discloses an auxiliary hanger rod support; U.S. Pat. No. 3,121,497 teaches a collapsible display rack for merchandise; U.S. Pat. No. 3,246,768 discloses a garment storage and display rack; and U.S. Pat. No. 3,395,811 teaches a knock-down garment rack which does not require tools for its assembly.

However, the prior art support racks for hanging items thereupon, unlike the present invention, do not employ detent mechanisms in combination with a rod detachable from a support surface for the purpose of creating a cantilever-type device for supporting hangable items such as clothing on hangers or hanging plants. Furthermore, unlike the prior art devices, the device of the present invention is especially suitable for incorporation in a modular support system for hanging items thereupon. Consequently, the present invention represents an improvement over prior art systems since it permits the flexibility and versatility of a modular system employing detent mechanisms and rods supported in a cantilever fashion.

SUMMARY OF THE INVENTION

Disclosed and claimed herein is a device for supporting hangable items thereupon, and a modular support system incorporating a plurality of such devices. The claimed device comprises a support surface, a socket, a detent mechanism, and an elongated rod. The elongated rod has a first end and a second free end, with the detent mechanism disposed proximate the first end. The socket is attached to the support surface and is configured to correspondingly engage with the detent mechanism. When the detent mechanism on the first end of the elongated rod is inserted into the socket, the detent mechanism engages to secure the rod in a substantially horizontal position extending away from the support surface in a cantilever fashion.

Any appropriate detent mechanism known in the mechanical arts may be implemented to secure the rod to the support surface in a cantilever fashion. For example, two types of suitable detent mechanisms are a ring and groove type detent mechanism and a pin and indent type detent mechanism.

A plurality of the claimed devices may be incorporated together to create a modular support system for hanging items thereupon. For example, one support surface may have several sockets formed therein at the same or varying heights so that when the corresponding rods are secured to the support surface, the hangable items may be displayed thereon at the various levels in an aesthetically-pleasing manner. Another alternative embodiment of the modular support system is envisioned wherein several support surfaces having at least one socket each and at least one corresponding rod are grouped together in an appealing arrangement. In any given modular support system, the height and spacing of each socket in each support surface may vary, the length and circumference of each rod may vary, and the detent mechanism employed may vary from socket to socket so long as the corresponding rod is configured accordingly. Furthermore, so long as the same detent mechanism is employed, the elements are deemed interchangeable. Thus a wide variety of configurations for the modular support system are envisioned by the present invention.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
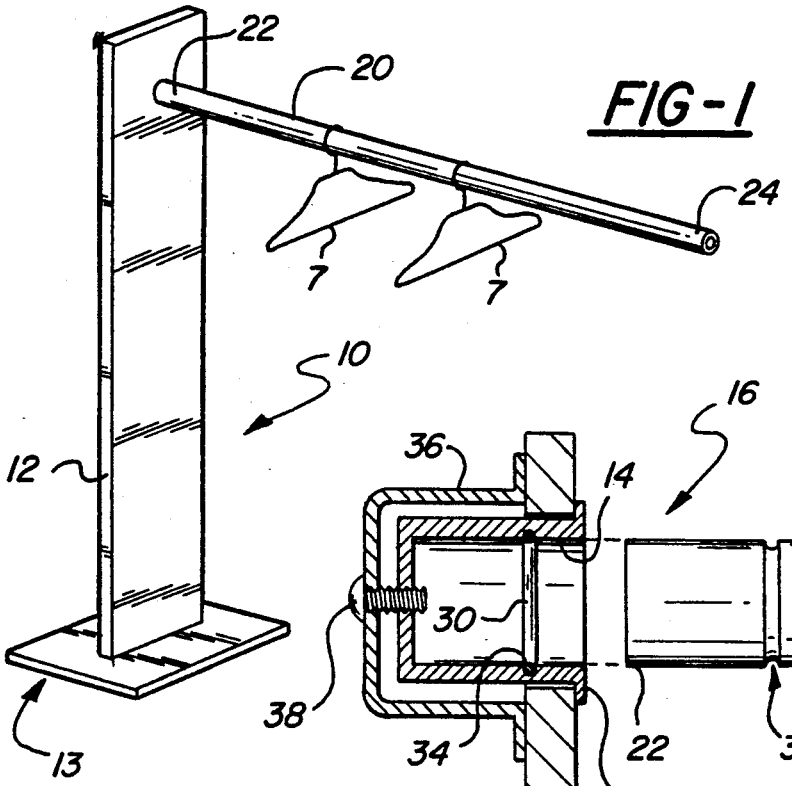
FIG. 1 is a perspective view of an embodiment of a device for supporting hangable items constructed in accord with the teachings of the present inventions having details of the detent mechanism thereof.
Figure 2:
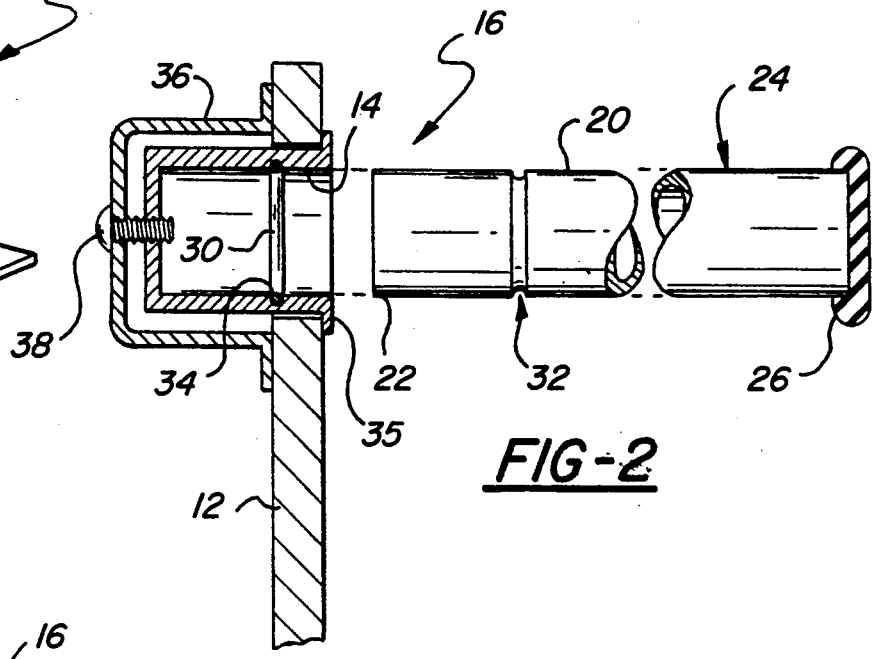
FIG. 2 is a cross-sectional view of an embodiment of the present invention.
Figure 3:
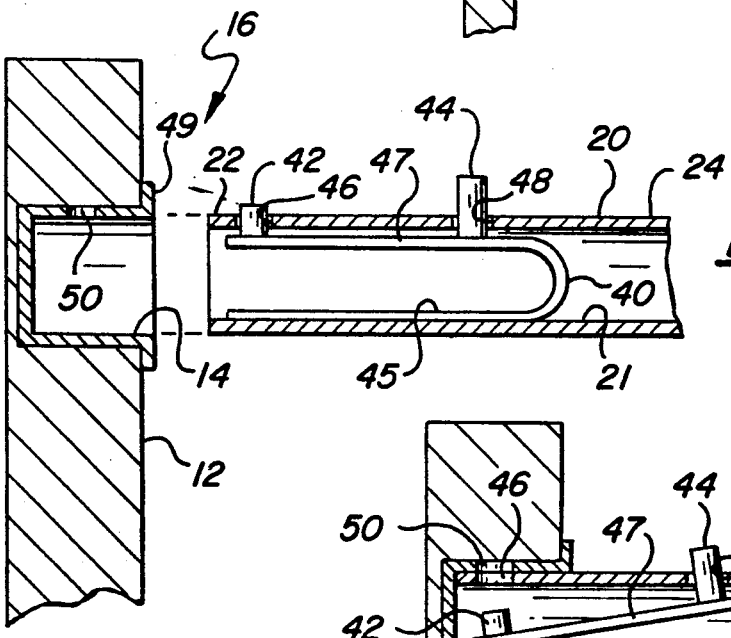
FIG. 3 is a cross-sectional view of another embodiment of the present invention having an alternate detent mechanism.
Figure 4:
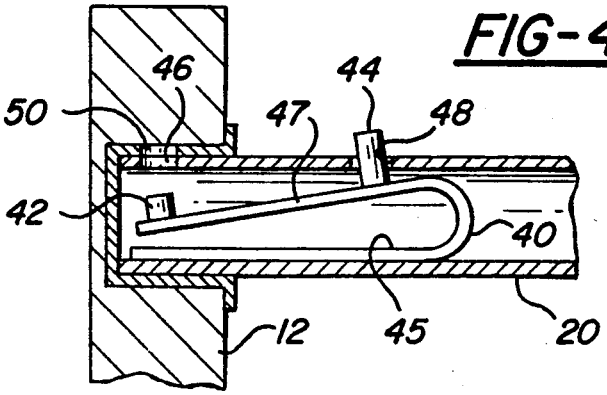
FIG. 4 is a cross-sectional view of the FIG. 3 embodiment demonstrating the functionality of the detent mechanism.

Referring now to the drawings and, in particular, to FIG. 1, there is depicted a device 10 for supporting hangable items such as clothes hangers 7. The device 10 includes a support surface 12, a socket 14, and an elongated rod 20 having a first end 22 and a second free end 24. The rod 20 is attached to the support surface 12 via a detent mechanism 16 (alternate versions of which are shown in FIGS. 2 and 3) disposed proximate the first end 22 of the rod 20. The rod 20 is oriented substantially horizontally and transverse the support surface 12, and is secured thereto in a cantilever fashion. By "substantially horizontally," it is meant that the rod 20 may be positioned either perpendicular to the support surface 12 or at an angle somewhat less than 90 degrees thereto so long as the rod 20 is still capable of supporting hangable items thereupon. For example, the rod 20 may be disposed at a 5 or 10 degree angle with respect to the vertical so that items hung thereon may be more advantageously displayed. FIGS. 2, 3 and 4, to be discussed in greater detail hereinbelow, describe the operation of two preferred detent mechanisms which may be used in practicing the present invention.

In one preferred embodiment shown in FIG. 1, the support surface 12 is a movable, free-standing upright 13. Other types of free-standing uprights, although not shown in the drawings, would be equally appropriate for purposes of the present invention provided they include a support surface disposed transverse the support rod 20. The length of the rod 20 must be calculated to correspond accordingly with the height of the free-standing upright 13 such that the upright 13 remains in an erect position and is not unbalanced by a rod of an inappropriate length. The weight of the items to be hung from the rod 20 must also be taken into consideration in order to maintain the balance of the present invention. Although not depicted in the drawings, the support surface 12 may also be a wall with a socket 14 mounted on the wall or flush with the wall surface.

In accordance with the present invention, a plurality of support surfaces 12, sockets 14, free-standing uprights 13, detent mechanisms 16, and rods 20 may be employed to collectively create an aesthetically-pleasing modular system for displaying hangable items such as clothing in a store display window. For example, a single support surface 12 may have more than one elongated rod 20 extending from it; the rods, in turn, may be of different lengths and attached to the support surface 12 at different levels or heights from the floor. A variety of freestanding uprights 13 of different sizes may be provided for increased design flexibility. A plethora of variations are thus envisioned by the modular hanging system of the present invention.

The detent mechanism 16 used to secure the rod 20 to the support surface 12 may be any one of a variety of known detent mechanisms. By way of example, two types of detent mechanisms 16 are specifically discussed herein: a ring and groove type (FIG. 2), and a pin and indent type (FIGS. 3 and 4). Such detent mechanisms are widely known in the mechanical arts. See, for example, U.S. Pat. Nos. 2,516,907; 2,660,457; 4,494,896; 4,932,540; and 4,747,621. However, the use of such detent mechanisms in combination with a rod detachable from a support surface for the purpose of creating a cantilever-type device for supporting hangable items such as clothing on hangers represents an improvement over prior art systems since it permits the flexibility and versatility of a modular system.

Referring now to FIG. 2, the use of a ring and groove type detent mechanism is shown in accordance with one preferred embodiment of the device of the present invention. Socket 14 is attached to the support surface 12 and secured in place by a U-shaped bracket 36 and a fastening means 38 such as a screw or bolt. Flange 35 prevents socket 14 from pushing through support surface 12. Welding the bracket 36 to the socket 14 would also be appropriate. The detent mechanism comprises a first groove 32 formed around the circumference of the first end 22 of the rod 20, a second groove 34 formed within the socket 14, and a split snap ring 30 disposed within the second groove 34. When the first end 22 of the rod 20 is inserted into the socket 14 having the second groove 34 formed therein, the ring 30 snap fits into groove 32, thus securing the rod 20 to the support surface 12 in a cantilever fashion. As further shown by FIG. 2, the second free end 24 of the rod 20 may optionally have a stopper mechanism 26 affixed thereto to prevent hangable items from sliding off the rod 20.

FIGS. 3 and 4 demonstrate the use of a pin and indent type of detent mechanism in accordance with another preferred embodiment of the device of the present invention. In this variation of detent mechanism, the first end 22 of rod 20 has a first opening 46 disposed proximate first end 22 and a second opening 48 spaced apart from first opening 46 along the length of the rod 20. A lever-type spring 40 configured as an elongated C has a first, fixed arm 45 and a second free arm 47. It is mounted within rod 20 such that fixed arm 45 is attached to the interior surface 21 of rod 20. A first pin 42 and a second pin 44 spaced therefrom are mounted on the free end 47 of spring 40 such that said first pin 42 is aligned to protrude through said first opening 46 and said second pin 44 is aligned to protrude through said second opening 48. An indentation 50 is disposed in the socket 14. Again, flange 49 keeps socket 14 in correct position within support surface 12. The spring 40 is biased such that first and second pins 42, 44 normally protrude through, respectively, first and second openings 46, 48 when the spring 40 is in its first position as shown in FIG. 3. The indentation 50 disposed inside socket 14 is configured to receive the first pin 42 therein.

As shown in FIG. 4, the second position of spring 40 is achieved when the second pin 44 is pressed and the free end 47 of spring 40 is deformed inwardly, causing the first pin 42 to retract completely into the rod 20 through first opening 46. While maintaining this second position, the first end 22 of the rod 20 is inserted into the socket 14. The second pin 44 is then released, allowing the first pin 42 to at least partially protrude through first opening 46. The rod 20 is then rotated within socket 14 until first pin 42 engages socket indentation 50, thus preventing further rotation of rod 20 and returning spring 40 to its first position. In this manner, the rod 20 is secured to the support surface 12 in a cantilever manner.

Due primarily to the ease of operating the detent mechanisms, the present invention is simple to assemble and disassemble without requiring any additional tools or mechanical expertise. Thus, the modular system of the present invention is especially well-suited for use in clothing displays that require frequent rearrangement, such as display windows in retail stores.

Thus it is apparent that there has been provided, in accordance with the invention, a device for supporting hangable items thereupon and a modular support system incorporating a plurality of such devices that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A device for supporting hangable items thereupon, comprising:

a support surface having a socket formed therein;

an elongated rod having a first end adapted to be inserted into said socket so that the rod extends substantially transversely to said surface and terminates in a second, free end; and a detent mechanism comprising a female member formed in one of said socket or said first rod end and, a male member supported on the other of said socket or said first rod end, the male member being resiliently biased for outward movement from its supporting member, such that, when said first rod end is inserted into said socket, said male member engages said female member and secures said rod within said socket to support said rod in a cantilever fashion.

2. The device of claim 1 wherein the surface is disposed on a movable, free-standing upright.

3. The device of claim 1 further comprising a stopper mechanism affixed to said second free end of said rod such that said items, when hung from said rod, are prevented from sliding off said rod.

4. The device of claim 1 wherein the female member of the detent mechanism comprises a first groove formed in said rod proximate said first end of said rod, and a split snap ring positioned in said first groove, and the male member of the detent mechanism comprises a second groove formed in the socket such that the split snap ring snap fits within the second groove when the rod is positioned inside the socket.

5. The device of claim 1 wherein the male member of the detent mechanism comprises a first opening disposed proximate said first end of the rod, a second opening spaced therefrom along the length of said rod and a lever-type spring mounted inside said rod and including a first fixed arm mounted on the interior of said rod, a second, free arm, and a first pin and a second pin mounted on the free arm of said spring and aligned with, respectively, said first opening and second opening; and the female member of the detent mechanism comprises an identation formed in said socket and configured to receive said first pin therein, said spring being biased to a first position, wherein said first pin protrudes through the first opening in said rod and said second pin protrudes through the second opening in said rod, and said spring being deformable upon pressing the second pin to a second position wherein the first pin retracts within the rod so that the rod may be inserted into the socket so that the first opening aligns with the identation such that, when the spring returns to the first position, said first pin engages with said identation to secure the rod to the support surface.

6. The device of claim 1 further comprising a bracket and a fastening means to attach said socket to said support surface.

7. The device of claim 1 further comprising a plurality of interchangeable support surfaces and a plurality of interchangeable rods, each of said plurality of rods being interchangeably securable to each of said plurality of support systems to achieve a variety of configurations of said device.

* * * * *